US005272053A

United States Patent [19]

Okumura et al.

[11] Patent Number: 5,272,053

[45] Date of Patent: Dec. 21, 1993

[54] SILVER HALIDE PHOTOGRAPHIC LIGHT-SENSITIVE MATERIAL

[75] Inventors: Mitsuhiro Okumura, Sagamihara; Shigeo Tanaka, Tachikawa; Hirokazu Sato, Hino, all of Japan

[73] Assignee: Konica Corporation, Tokyo, Japan

[21] Appl. No.: 992,486

[22] Filed: Dec. 15, 1992

[30] Foreign Application Priority Data

Jan. 29, 1992 [JP] Japan ..... 4-14317

[51] Int. Cl.[5] ..... G03C 1/005

[52] U.S. Cl. ..... 430/640; 430/642; 430/943; 430/545; 430/558; 430/963; 430/569; 430/567

[58] Field of Search ..... 430/640, 642, 943, 545, 430/558, 963, 569, 567

[56] References Cited

U.S. PATENT DOCUMENTS

| | | | |
|---|---|---|---|
| 4,183,756 | 1/1980 | Locker | 430/569 |
| 4,225,666 | 9/1980 | Locker et al. | 430/569 |
| 4,680,255 | 7/1987 | Maskasky | 430/567 |
| 4,713,323 | 12/1987 | Maskasky | 430/569 |
| 4,978,603 | 12/1990 | Inoue et al. | 430/567 |
| 5,116,990 | 5/1992 | Kimura et al. | 430/558 |

FOREIGN PATENT DOCUMENTS

| | | | |
|---|---|---|---|
| 0399541 | 11/1990 | European Pat. Off. . | |
| 0428899 | 5/1991 | European Pat. Off. | 430/558 |
| 0070221 | 4/1983 | Japan . | |
| 59-195232 | 6/1984 | Japan . | |

OTHER PUBLICATIONS

Maskasky—"A Comparison of Oxidized and Non-Oxidized Gelatin II Precipitation of Tabular Grains'-'—Journal of Imaging Science, vol. 33—No. 1, Jan. 1989, pp. 13 to 17.

*Primary Examiner*—Charles L. Bowers, Jr.
*Assistant Examiner*—Thomas R. Neville
*Attorney, Agent, or Firm*—Finnegan, Henderson, Farabow, Garrett & Dunner

[57] ABSTRACT

A silver halide photographic light-sensitive material is disclosed. The light-sensitive material comprises a support and a silver halide emulsion layer provided on the support, and the silver halide emulsion layer comprises a hydrogen peroxide-treated gelatin in a ratio of not lower than 20% by weight to the total amount of gelatin contained in the silver halide emulsion layer and silver halide grains composed of silver chlorobromide having a silver chloride content of not lower than 90 mol %. The light-sensitive material is improved in the stability of emulsion coating solutions.

6 Claims, No Drawings

SILVER HALIDE PHOTOGRAPHIC LIGHT-SENSITIVE MATERIAL

FIELD OF THE INVENTION

The present invention relates to a silver halide photographic light-sensitive material, hereinafter also referred to as "light-sensitive material", more specifically a rapidly processable light-sensitive material resistant to fluctuation in photographic characteristics caused by standing of coating solution during preparation of the light-sensitive material, hereinafter referred to as coating solution stability and in color reproduction and image storage stability.

BACKGROUND OF THE INVENTION

In recent years, with increasing demand for shortening the delivery time for photographic prints and improving printing productivity, there has been a tendency for printing time to be shortened by rapid development using silver halides having high silver chloride contents for high developing speed and by sensitivity improvement in photographic light-sensitive materials for printing. However, silver chloride emulsions are poor in coating solution stability. The poor stability of coating solution causes a large fluctuation in sensitivity and gradation within a lot, thus limiting lo size expansion.

Also, other problems arise in multi-layered color light-sensitive materials; for example, sensitivity and gradation differences among layers hamper the obtainment of the desired photographic performance due to imbalance in color, and unevenness in photographic characteristics within a lot results in considerable yield reduction when prints are made under predetermined exposure conditions in photo-finishing laboratorys in the case of light-sensitive materials for color printing paper because different printing results are obtained from different rolls.

To prevent such characteristics deterioration during standing of coating solution, there have been proposed a number of methods, including the method in which an azole, an azaindene compound or another known stabilizer is added, the method in which a reducing agent such as hydroquinone or sulfinic acid is added, the method using a combination of a copolymer and a brightening agent, as described in Japanese Patent Publication Open to Public Inspection (hereinafter referred to as Japanese Patent O.P.I. Publication) No. 111629/1974, and the method in which a sensitizing dye is added to coating solution, as described in Japanese Patent O.P.I. Publication No. 7629/1983. However, none of these methods, whether used singly or in combination, could be considered satisfactory.

On the other hand, unlike the conventional 5-pyrazolone-based magenta coupler, the recently-developed 1H-pyrazolo-[1,5-b]-1,2,4-triazole-based magenta coupler offers excellent color reproduction because of the absence of undesirable absorption around 430 nm in the resulting coloring dye, but the magenta dye thus obtained is known to be poor in light fastness.

Meantime, Japanese Patent O.P.I. Publication No. 262159/1985, for instance, describes the use of a phenol or phenyl ether compound to improve light fastness; however, the obtained effect remains unsatisfactory, and further improvement is desired.

Attempts to improve light fastness have been made from the viewpoint of coupler structure as well. For example, the 1H-pyrazolo-[1,5-b]-1,2,4-triazole-based magenta couplers described in Japanese Patent O.P.I. Publication Nos. 307453/1988, 66646/1989, 161430/1990, 296241/1990, 111943/1990 and 138644/1991, all of which have a bulky substituent at 6 position, are known to be excellent in light fastness. However, the use of these couplers poses a problem of further deterioration of coating solution stability, and improvement is demanded strongly.

SUMMARY OF THE INVENTION

The present invention has been made in view of this situation. Accordingly, the object of the present invention is to provide a light-sensitive material for rapid processing excellent in coating solution stability, color reproduction and image storage stability.

The object of the invention has been accomplished by a silver halide photographic light-sensitive material comprising a support and a silver halide emulsion layer provided on the support, in which the silver halide emulsion layer comprises a hydrogen peroxide-treated gelatin in a ratio of not lower than 20% by weight to the total amount of gelatin contained in the silver halide emulsion layer and silver halide grains composed of silver chlorobromide having a silver chloride content of not lower than 90 mol %.

Particularly better results were obtained by the use of a light-sensitive material wherein at least one silver halide emulsion layer contains a magenta coupler represented by the following formula M-I:

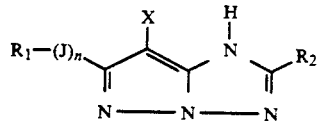

Formula M-I wherein J represents —O—, —S— or —N($R_3$)—, $R_3$ represents a hydrogen atom or a substituent; n represents 0 or 1; provided that n is 0, $R_1$ represents an alkyl group or aryl group having 2 or more carbon atoms, and provided that n is 1, $R_1$ represents an alkyl group or an aryl group; $R_2$ represents a hydrogen atom or a substituent; X represents a hydrogen atom or a substituent capable of splitting off upon reaction with the oxidation product of a color developing agent.

DETAILED DESCRIPTION OF THE INVENTION

The magenta coupler represented by formula M-I is described below.

Provided that n is 0, the alkyl group represented by $R_1$ is preferably one having 2 to 32 carbon atoms, whether linear or branched, with preference given to a branched alkyl group. Provided that n is 1, the alkyl group represented by $R_1$ is preferably one having 1 to 32 carbon atoms, whether linear or branched. The aryl group represented by $R_1$ is preferably a phenyl group.

The alkyl group or aryl group represented by $R_1$ may have a substituent.

Although the substituent represented by $R_2$ or $R_3$ is not subject to limitation, typical examples thereof include alkyl groups, aryl groups, anilino groups, acylamino groups, sulfonamide groups, alkylthio groups, arylthio groups, alkenyl groups and cycloalkyl groups. Examples also include halogen atoms, cycloalkenyl groups, alkinyl groups, heterocyclic groups, sulfonyl groups, sulfinyl groups, phosphonyl groups, acyl groups, carbamoyl groups, sulfamoyl groups, cyano groups, alkoxy groups, aryloxy groups, heterocyclic oxy groups, siloxy groups, acyloxy groups, carbamoyloxy groups, amino groups, alkylamino groups, imido groups, ureido groups, sulfamoylamino groups, alkoxycarbonylamino groups, aryloxycarbonylamino groups, alkoxycarbonyl groups, aryloxycarbonyl groups, heterocyclic thio groups, spiro compound residues and bridged hydrocarbon compound residues.

The alkyl group represented by $R_2$ or $R_3$ is preferably one having 1 to 32 carbon atoms, whether linear or branched. The aryl group represented by $R_2$ or $R_3$ is preferably a phenyl group.

The acylamino group represented by $R_2$ or $R_3$ is exemplified by an alkylcarbonylamino group and an arylcarbonylamino group. The sulfonamide group represented by $R_2$ or $R_3$ is exemplified by an alkylsulfonylamino group and an arylsulfonylamino group.

The alkyl moiety or aryl moiety in the alkylthio group or arylthio group represented by $R_2$ or $R_3$ is exemplified by the alkyl groups or aryl groups represented by the above $R_2$ or $R_3$.

The alkenyl group represented by $R_2$ or $R_3$ is preferably one having 2 to 32 carbon atoms, whether linear or branched. The cycloalkyl group represented by $R_2$ or $R_3$ preferably has 3 to 12 carbon atoms, with preference given to one having 5 to 7 carbon atoms. The cycloalkenyl group preferably has 3 to 12 carbon atoms, with preference given to one having 5 to 7 carbon atoms.

Examples of the sulfonyl group represented by $R_2$ or $R_3$ include alkylsulfonyl groups and arylsulfonyl groups. Examples of the sulfinyl group represented by $R_2$ or $R_3$ include alkylsulfinyl groups and arylsulfinyl groups. Examples of the phosphonyl group represented by $R_2$ or $R_3$ include alkylphosphonyl groups, alkoxyphosphonyl groups, arylphosphonyl groups and aryloxyphosphonyl groups. Examples of the acyl group represented by $R_2$ or $R_3$ include alkylcarbonyl groups and arylcarbonyl groups. Examples of the carbamoyl group represented by $R_2$ or $R_3$ include alkylcarbamoyl groups and arylcarbamoyl groups. Examples of the sulfamoyl group represented by $R_2$ or $R_3$ include alkylsulfamoyl groups and arylsulfamoyl groups. Examples of the acyloxy group represented by $R_2$ or $R_3$ include alkylcarbonyloxy groups and arylcarbonyloxy groups. Examples of the carbamoyloxy group represented by $R_2$ or $R_3$ include alkylcarbamoyloxy groups and arylcarbamoyloxy groups. Examples of the ureido group represented by $R_2$ or $R_3$ include alkylureido groups and arylureido groups. Examples of the sulfamoylamino group represented by $R_2$ or $R_3$ include alkylsulfamoylamino groups and arylsulfamoylamino groups. The heterocyclic group represented by $R_2$ or $R_3$ is preferably a 5- to 7-membered ring, including a 2-furyl group, a 2-thienyl group, a 2-pyrimidinyl group and a 2-benzothiazolyl group. The heterocyclic oxy group represented by $R_2$ or $R_3$ preferably has a 5- to 7-membered heterocyclic ring, including a 3,4,5,6-tetrahydropyranyl-2-oxy group and a 1-phenyltetrazol-5-oxy group. The heterocyclic thio group represented by $R_2$ or $R_3$ is preferably a 5- to 7- membered heterocyclic thio group, including a 2-pyridylthio group, a 2-benzothiazolylthio group and a 2,4-diphenoxy-1,3,5-triazole-6-thio group. Examples of the siloxy group represented by $R_2$ or $R_3$ include a trimethylsiloxy group, a triethylsiloxy group and a dimethylbutylsiloxy group. Examples of the imido group represented by $R_2$ or $R_3$ include a succinimido group, a 3-heptadecylsuccinimido group, a phthalimido group and a glutarimido group. Examples of the spiro compound residue represented by $R_2$ or $R_3$ include spiro[3.3]heptan-1-yl. Examples of the bridged hydrocarbon compound residue represented by $R_2$ or $R_3$ include bicyclo[2.2.1]heptan-1-yl, tricyclo[3.3.1.1$^{37}$]decan-1-yl and 7,7-dimethyl-bicyclo[2.2.1-]heptan-1-yl.

Examples of the group capable of splitting off upon reaction with the oxidation product of a color developing agent, represented by X, include halogen atoms such as a chlorine atom, a bromine atom and a fluorine atom, alkoxy groups, aryloxy groups, heterocyclic oxy groups, acyloxy groups, sulfonyloxy groups, alkoxycarbonyloxy groups, alkyloxaryloxy groups, alkoxyoxaryloxy groups, alkylthio groups, arylthio groups, heterocyclic thio groups, alkoxythiocarbonylthio groups, and nitrogen-containing heterocyclic rings of the $6\pi$ or $10\pi$ electron system bound via nitrogen atoms.

Of the magenta couplers represented by formula M-I, those represented by the following formula M-II or M-III are preferable.

Formula M-II

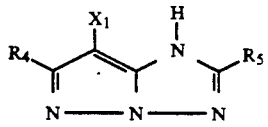

Formula M-III

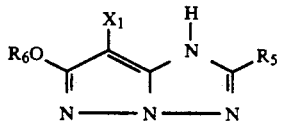

In the above formulas, $R_4$ represents an isopropyl group or a t-butyl group; $R_5$ represents a substituent; $R_6$ represents an alkyl group or an aryl group; $X_1$ represents a group capable of splitting off upon reaction with the oxidation product of a color developing agent.

The alkyl group represented by $R_6$ is preferably one having 1 to 32 carbon atoms, whether linear or branched. The aryl group represented by $R_6$ is preferably a phenyl group. The alkyl group and aryl group may have a substituent.

The substituent represented by $R_5$ is exemplified by the substituents represented by $R_2$ in the above formula M-I, with preference given to an alkyl group or an aryl group, more preferably a group represented by the following formula M-IV or M-V.

Formula M-IV

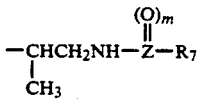

wherein Z represents an atom of carbon or sulfur; provided than Z is a carbon atom, m represents 1, and provided than Z is a sulfur atom, m represents 2; $R_7$ represents an alkyl group or an aryl group.

The alkyl group represented by $R_7$ is preferably one having 1 to 32 carbon atoms, whether linear or branched. The aryl group represented by $R_7$ is preferably a phenyl group. The alkyl group and aryl group may have a substituent.

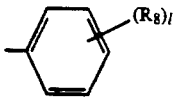

Formula M-V wherein $R_8$ represents a substituent; 1 represents an integer of 0 to 5.

The substituent represented by $R_8$ is exemplified by the substituents represented by $R_2$ in the above formula M-I.

Examples of the group capable of splitting off upon reaction with the oxidation product of a color developing agent, represented by $X_1$, include the groups represented by X in the above formula M-I, with preference given to a fluorine atom, a chlorine atom or a group represented by one of the following formulas M-IV through M-VIII:

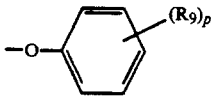

Formula M-VI wherein $R_9$ represents a substituent; p represents an integer of 0 to 5.

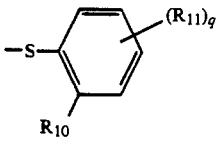

Formula M-VII wherein $R_{10}$ and $R_{11}$ independently represent a substituent; q represents an integer of 0 to 4.

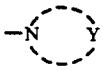

Formula M-VIII wherein Y represents a group of non-metal atoms necessary to form a 5- to 7-membered ring in cooperation with the nitrogen atom.

The substituents represented by $R_9$, $R_{10}$ and $R_{11}$ are exemplified by the substituents represented by $R_2$ in the above formula M-I. For $R_{10}$, preference is given to a group bonded with te benzene ring via an oxygen atom or a nitrogen atom, particularly an alkoxy group or an acylamino group.

Typical examples of the magenta coupler for the present invention, represented by formula M-I (hereinafter referred to as the magenta coupler of the present invention), are given below, which are not to be construed as limitative.

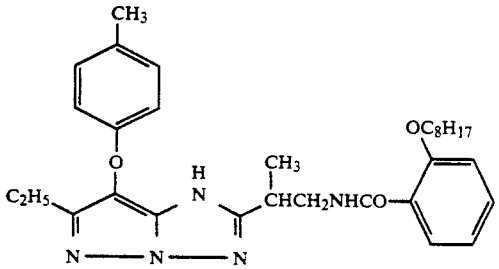

(M-1)

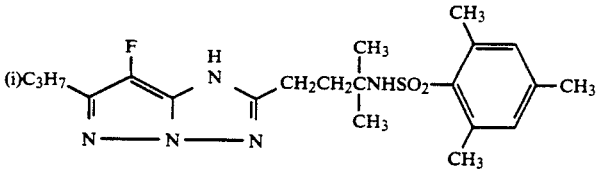

(M-2)

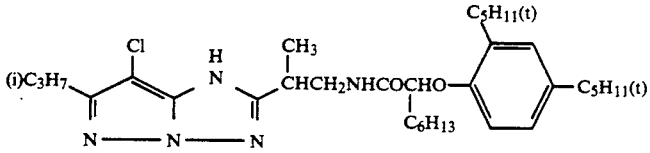

(M-3)

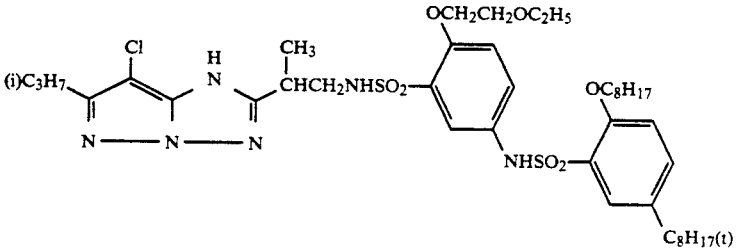

(M-4)

-continued
(M-5)
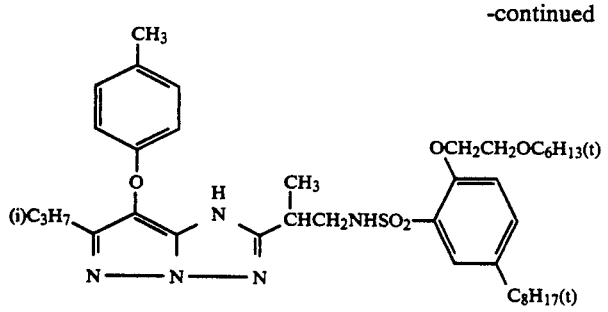
(M-6)
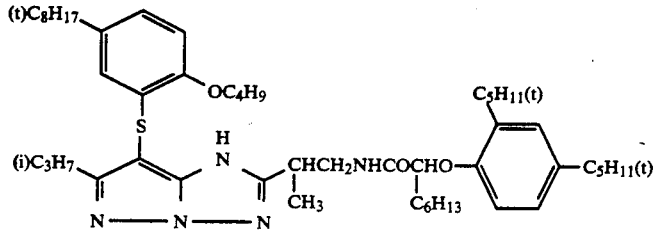
(M-7)
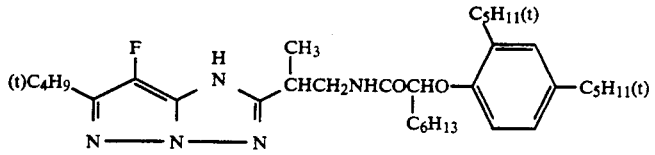
(M-8)
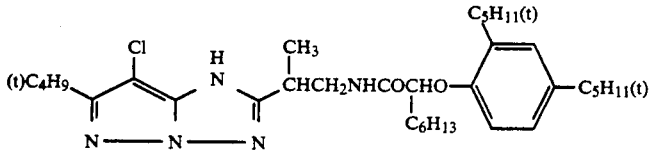
(M-9)
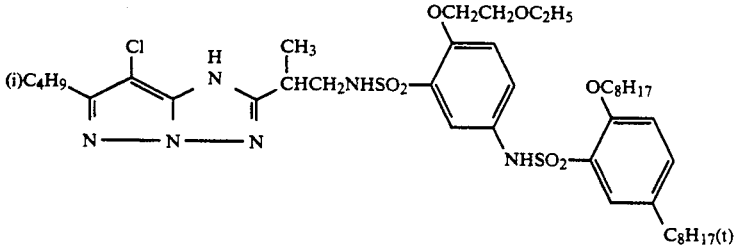
(M-10)
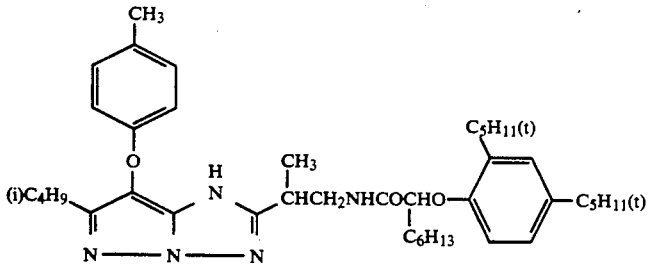
(M-11)
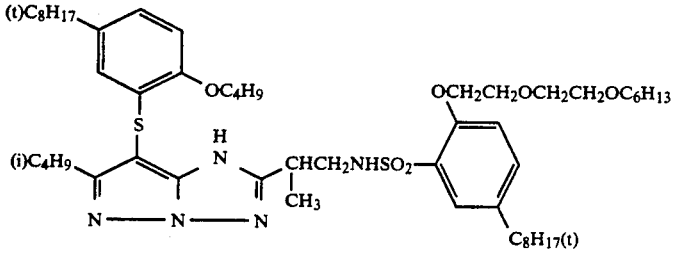

-continued
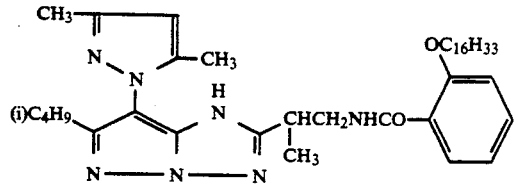
(M-12)
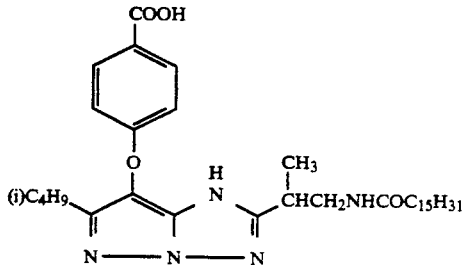
(M-13)
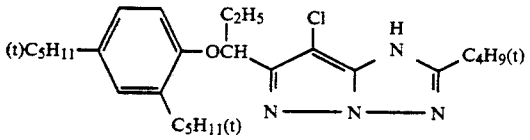
(M-14)
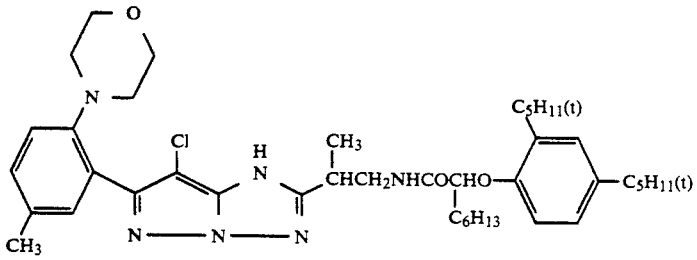
(M-15)
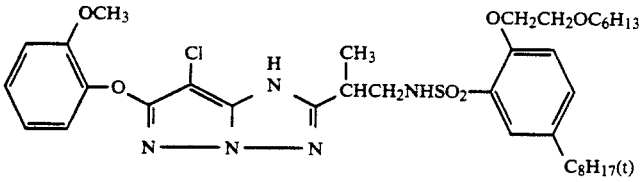
(M-16)
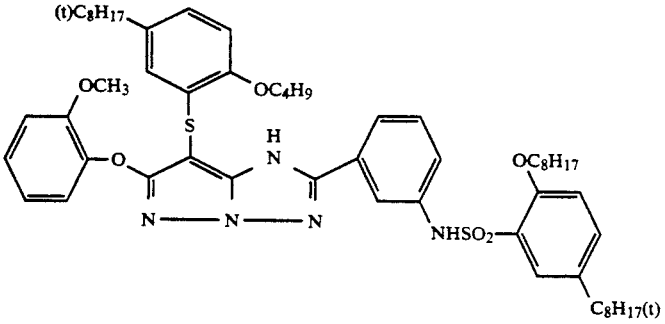
(M-17)

-continued
(M-18)
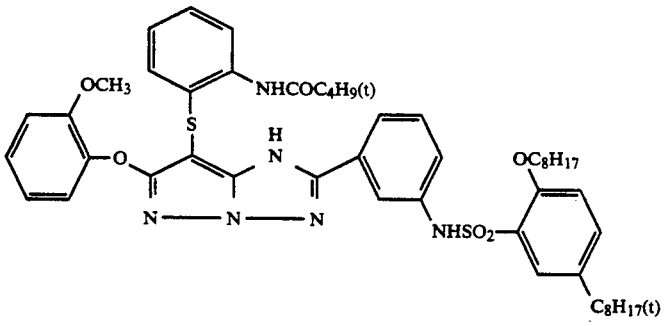
(M-19)
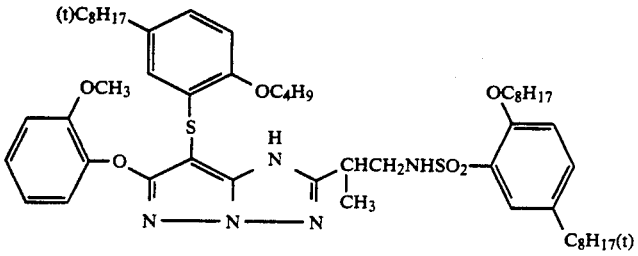
(M-20)
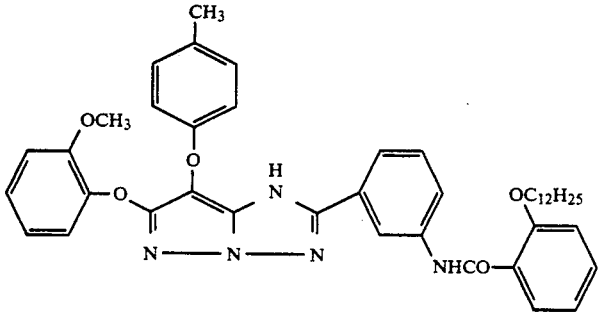
(M-21)
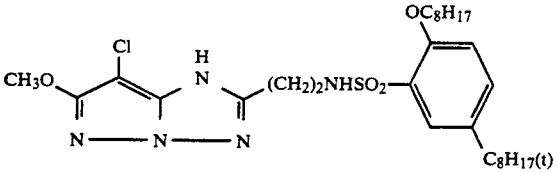
(M-22)
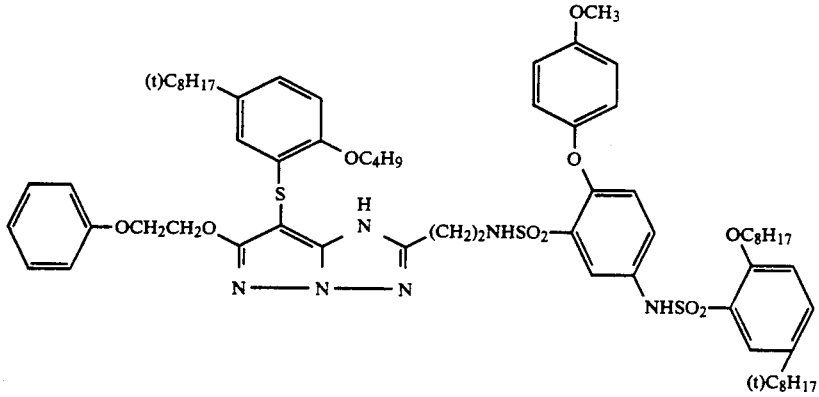

-continued (M-23)

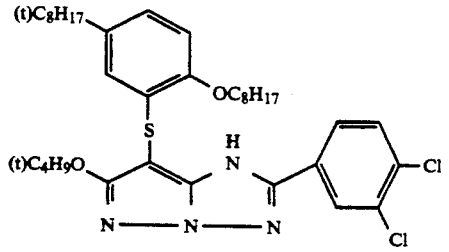

(M-24)

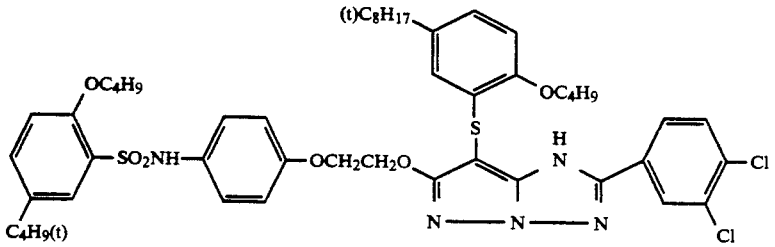

(M-25)

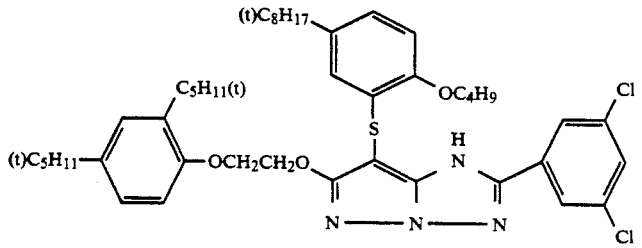

(M-26)

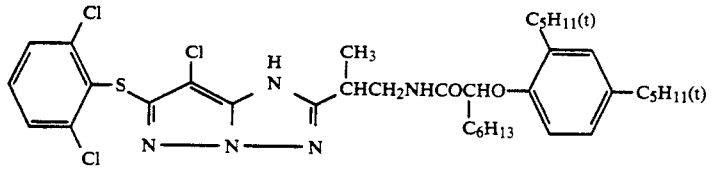

(M-27)

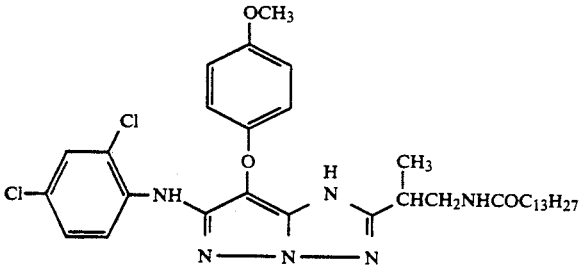

In addition to the above compounds, examples of the magenta coupler of the present invention include Example Compound Nos. 1 through 15 described on pages 6 and 7 of Japanese Patent O.P.I. Publication No. 307453/1988, Example Compound Nos. 1 through 31, 46 through 50 and 52 through 60 described on pages 8 through 14 of Japanese Patent O.P.I. Publication No. 7047/1989, Example Compound Nos. I-1 through I-24 described on pages 3 through 5 of Japanese Patent O.P.I. Publication No. 66646/1989, Example Compound Nos. 6 through 8, 10, 12 through 15, 18 and 20 described on pages 5 and 6 of Japanese Patent O.P.I. Publication No. 277236/189, Example Compound Nos. M-4 through M-35, M-37 and M-50 through M-53 described on pages 11 through 18 of Japanese Patent O.P.I. Publication No. 160233/1990, Example Compound Nos. M-1 through M-89 described on pages 5 through 9 of Japanese Patent O.P.I. Publication No. 161430/1990, Example Compound Nos. M-1 through M-6, M-8 through M-12 and M-14 through M-27 described on pages 5 through 8 of Japanese Patent O.P.I. Publication No. 296241/1990, Example Compound Nos. M-2 through M-29 and m-2 through m-28 described on pages 5 through 7 and 35 of Japanese Patent O.P.I. Publication No. 138645/1991, Example Compound Nos. M-3 through M-5, M-7 through M-12, M-14 and M-16 through M-30 described on pages 5 through 9 of Japanese Patent O.P.I. Publication No. 200143/1991, and Example Compound Nos. M-1 through M-38 described on pages 6 through 10 of Japanese Patent O.P.I. Publication No. 138644/1991.

The magenta coupler of the present invention can be synthesized in accordance with the methods described in the above patent publications.

The magenta coupler of the present invention is used in the content ratio of $1\times10^{-3}$ to 1 mol, preferably $1\times10^{-2}$ to $7\times10^{-1}$ mol per mol of silver halide.

The gelatin used for the present invention is described below.

The gelatin for the present invention is characterized by hydrogen peroxide treatment. Commercially available aqueous hydrogen peroxide can be used in the amount range from 0.1 to 3.0 g, preferably from 0.3 to 1.0 g in terms of pure hydrogen peroxide per kg of gelatin. Use of an excessive amount of hydrogen peroxide may deteriorate physical properties of gelatin.

The treatment with hydrogen peroxide can be performed by addition of hydrogen peroxide at various steps for producing gelatin such as at starting, during or finishing time of liming of ossein, before or after of washing of limed ossein, or after extraction of gelatin from ossein. After addition of hydrogen peroxide, the reaction system is stirred for about 2 hours at a prescribed temperature at neutral or alkali condition at a pH of not lower than 9.0, preferably not more than 10.0. After treatment with the aqueous hydrogen peroxide, it is necessary to remove hydrogen peroxide by thorough washing before proceeding to the next process.

Any gelatin can be used for the present invention, as long as it meets the above requirements. Examples of such gelatin include alkali-processed gelatin, acid-processed gelatin, enzyme-processed gelatin, gelatin derivatives and modified gelatin. For the purpose of the present invention, greatest preference is given to alkali-processed ossein gelatin.

The hydrogen peroxide treatment may be conducted at any time in the gelatin production process; hydrogen peroxide may be added to the starting material osseinized bone or the gelatin liquid extract. It is usually preferable to add hydrogen peroxide to the extracted gelatin solution.

When the light-sensitive material of the present invention contains different kinds of gelatin, the content ratio of gelatin treated with hydrogen peroxide to the total gelatin content must exceed 20% by weight for the desired effect of the present invention, preferably not less than 50% by weight, more preferably not less than 80% by weight. Although the gelatin for the present invention is used as gelatine to be added to a silver halide emulsion after chemical ripening, it may also be used for dispersion of coupler. Preferably, the gelatin for the present invention is also used for dispersion of coupler to increase its content ratio.

The jelly strength (determined by the PAGI method) of the gelatin for the present invention is preferably not less than 250 g, more preferably not less than 270 g.

The calcium content (determined by the PAGI method) of the gelatin for the present invention is preferably not more than 1000 ppm, more preferably not more than 500 ppm To reduce the calcium content of gelatin, it is preferable to employ a treatment with an ion exchange resin column.

Although there is no limitation, the average molecular weight of the gelatin for the present invention is preferably 10,000 to 200,000.

The total amount of gelatin contained in the light-sensitive material of the present invention is preferably less than 7.0 g/m$^2$. Although there is no limitation with respect to lower limit, it is preferable from the viewpoint of physical properties and photographic performance that the total gelatin content be not less than 3.0 g/m$^2$. The gelatin content is obtained on the basis of the weight of gelatin as having a water content of 11.0% determined by the PAGI method.

The gelatin contained in the light-sensitive material of the present invention may be hardened with a hardener.

Any hardener can be used for this purpose without limitation. Examples include hardeners known in the photographic industry, specifically those based on aldehyde, active vinyl, active halogen, epoxy, ethyleneimine, carboxyl-activating hardener such as methane sulfonate, carbodiimide, isoxazole and carbamoylpyridinium salt, and polymer hardeners. The particularly preferable hardeners are those based on vinyl sulfone such as Compound Nos. H-1 through H-24 described on pages 13 and 14 of Japanese Patent O.P.I. Publication No. 188753/1990, and/or those based on chlorotriazine such as Compound Nos. II-1 through II-13 and III-1 through III-10 described on pages 20 and 21 of Japanese Patent O.P.I. Publication No. 216340/1989, or the carboxyl-activated hardeners described in Japanese Patent O.P.I. Publication Nos. 82237/1990 and 129245/1989.

The swelling rate of the light-sensitive material of the present invention, i.e., the ratio of the thickness of the hydrophilic colloid layer in the processing solution to the thickness of the hydrophilic colloid layer in a dry state is preferably 1.5 to 4.0, more preferably 2.0 to 3.0.

The silver halide used in the silver halide emulsion layer for the present invention may be any silver halide, whether it is silver chloride, silver bromide, silver iodide, silver chlorobromide, silver iodobromide or silver chloroiodide.

The silver halide grains preferably used for the present invention have a silver chloride content of not less than 90 mol %, a silver bromide content of not more than 10 mol % and a silver iodide content of not more than 0.5 mol %, with preference given to a silver chlorobromide having a silver bromide content of 0.1 to 2 mol %. The silver halide grains may be used singly or in combination with other kinds of silver halide grains of different compositions, and may also be used in combination with silver halide grains having a silver chloride content of not more than 90 mol %. In a silver halide emulsion layer containing silver halide grains having a silver chloride content of not less than 90 mol %, the silver halide grains having a silver chloride content of not less than 90 mol % account for not less than 60% by weight, preferably not less than 80% by weight of the total silver halide grain content of the emulsion layer. The composition of the silver halide grains may be uniform from inside to outside, or may vary from inside and outside. The composition change may be continuous or discontinous.

Although the grain size of silver halide grains is not subject to limitation, it is preferable, in view of other photographic performance requirements such as rapid processing and high sensitivity, that the grain size be in the range from 0.2 to 1.6 μm, more preferably from 0.25 to 1.2 μm.

The grain size distribution of silver halide grains may be polydispersed or monodispersed. Preferred silver halide grains are monodispersed silver halide grains having a coefficient of variance of silver halide grain distribution of not more than 0.22, more preferably not more than 0.15. Here, the coefficient of variance is a coefficient indicating grain size distribution, as defined by the following equation: Coefficient of variance = grain size distribution standard deviation/average grain size

The silver halide grains used for the present invention may be prepared by any of the acidic method, the neutral method and the ammoniacal method. These grains may be grown at once or grown after seed grain formation. The method of preparing the seed grains and the method of growing them may be identical or different. As for the mode of reaction of a soluble silver salt and a soluble halide, any of the normal precipitation method, the reverse precipitation method, the double jet precipitation method and combinations thereof may be used, but the grains obtained by the simultaneous precipitation method are preferred. As a mode of the double jet precipitation method, the pAg-controlled double jet method, which is described in Japanese Patent O.P.I. Publication No. 48521/1979, can also be used.

If necessary, a silver halide solvent such as thioether or imidazole may be used. Also, a compound containing a mercapto group, a nitrogen-containing heterocyclic compound or a sensitizing dye may be added at the time of formation of silver halide grains or after completion of grain formation.

The silver halide grains for the present invention may come in any shape. A preferred shape is a cube having {100} planes to form the crystal surface.

It is also possible to use octahedral, tetradecahedral, dodecahedral or other forms of grains prepared by the methods described in U.S. Pat. Nos. 4,183,756 and 4,225,666, Japanese Patent O.P.I. Publication No. 26589/1980, Japanese Patent Examined Publication No. 42737/1980 and the Journal of Photographic Science, 21, 39 (1973). Grains having twin crystal planes may also be used. The silver halide grains for the present invention may be of a single shape or a combination of various shapes.

The silver halide grains used for the present invention may be doped with metal ions using a cadmium salt, a zinc salt, a lead salt, a thallium salt, an iridium salt or a complex salt thereof, a rhodium salt or a complex salt thereof or an iron salt or a complex salt thereof to contain such metal elements in and/or on the grains during formation and/or growth of silver halide grains. Also, reduction sensitization specks can be provided in and/or on the grains by bringing the grains in an appropriate reducing atmosphere.

The emulsion containing silver halide grains may be treated to remove the undesirable soluble salts after completion of growth of the silver halide grains or may retain the soluble salts.

The silver halide grains used in the emulsion for the present invention may be grains wherein latent images are formed mainly on the surface thereof or grains wherein latent images are formed mainly therein, with preference given to grains wherein latent images are formed mainly on the surface thereof.

In the present invention, the emulsion is chemically sensitized by a conventional method. Specifically, sulfur sensitization, which uses either a compound containing sulfur capable of reacting with silver ion or active gelatin, selenium sensitization, which uses a selenium compound, reduction sensitization, which uses a reducing substance, noble metal sensitization, which uses gold or another noble metal, and other sensitizing methods can be used singly or in combination.

The emulsion can also be optically sensitized in the desired wavelength band using a sensitizing dye. Sensitizing dyes which can be used for the present invention include cyanine dyes, merocyanine dyes, complex cyanine dyes, complex merocyanine dyes, holopolar cyanine dyes, hemicyanine dyes, styryl dyes and hemioxanol dyes. Examples of such sensitizing dyes include Example Compound Nos. BS-1 through BS-9, GS-1 through GS-5, RS-1 through RS-8 and IRS-1 through IRS-10 specified on pages 76 through 82 of Japanese Patent Application No. 76278/1990. Examples of supersensitizers which can be used in combination therewith include Example Compound Nos. SS-1 through SS-9 specified on pages 84 and 85 of Japanese Patent Application No. 76278/1990.

It is common practice to select dye-forming couplers for use in the light-sensitive material of the present invention so that a dye absorbing light corresponding to the sensitization spectral sensitivity of each emulsion layer is formed; a yellow coupler, a magenta coupler and a cyan coupler are used in the blue-, green- and red-sensitive emulsion layers, respectively. However, the color photographic light-sensitive material may be prepared using these couplers in different combinations according to the purpose.

In the present invention, acylacetoanilide-based couplers can be preferably used as yellow couplers, of which benzoylacetoanilide and pivaloylacetoanilide compounds are advantageous.

Examples of yellow couplers preferably used for the present invention are given below.

YC-1

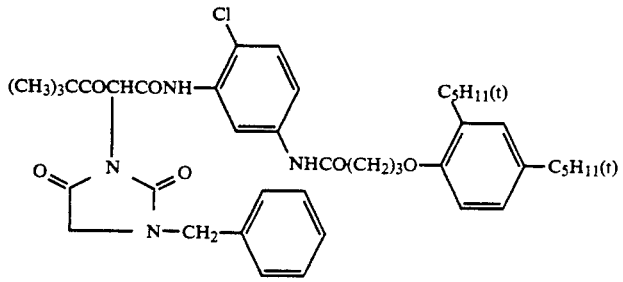

-continued
YC-2
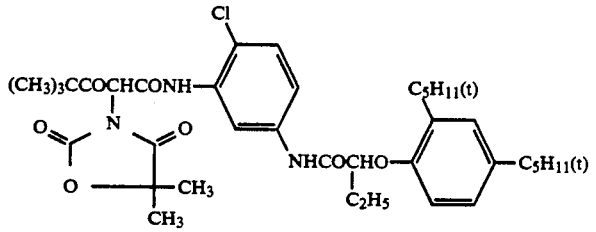
YC-3
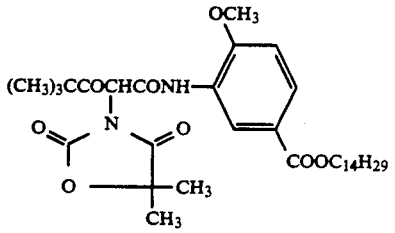
YC-4
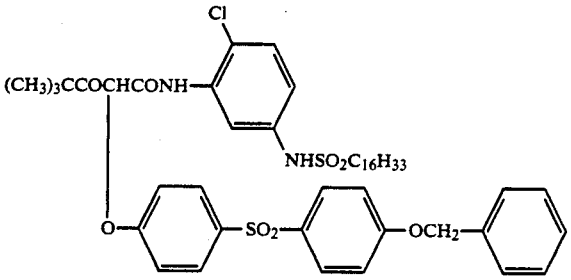
YC-5
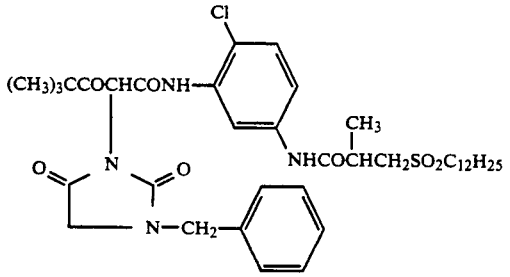
YC-6
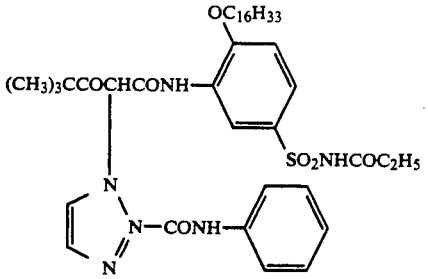
YC-7
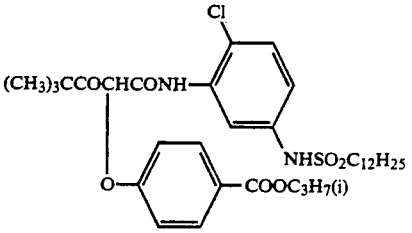

-continued

YC-8

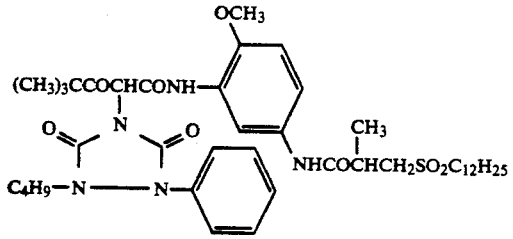

YC-9

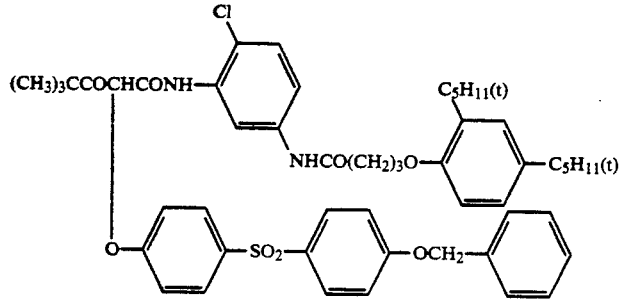

YC-10

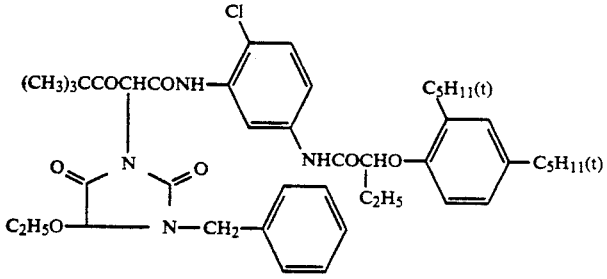

YC-11

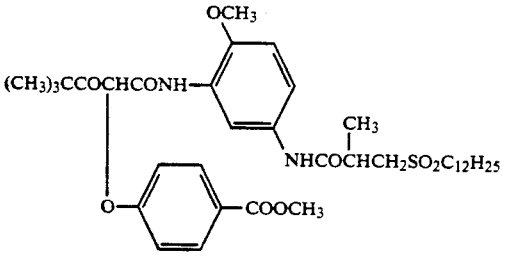

In addition to the above compounds, examples include Example Compound Nos. Y-1 through Y-146 described on pages 7 through 16 of Japanese Patent O.P.I. Publication No. 85631/1988, Example Compound Nos. Y-1 through Y-98 described on pages 6 through 10 of Japanese Patent O.P.I. Publication No. 97951/1988, Example Compound Nos. Y-1 through Y-24 described on pages 18 through 20 of Japanese Patent O.P.I. Publication No. 156748/1989, Example Compound Nos. I-1 through I-50 described on pages 4 through 7 of Japanese Patent O.P.I. Publication No. 298943/1990, and Example Compound Nos. Y-1 through Y-48 described on pages 114 through 120 of Japanese Patent O.P.I. Publication No. 215272/1987.

In the present invention, naphthol-based and phenol-based couplers can be used preferably as cyan couplers.

In addition to naphthol-based and phenol-based cyan couplers, there may be used advantageously imidazole-based cyan couplers such as those disclosed in Japanese Patent O.P.I. Publication Nos. 156748/1989, 174153/1991 and 196039/1991, pyrazoloazole-based cyan couplers and pyrazoloazine-based cyan couplers such as those described in Japanese Patent O.P.I. Publication Nos. 136854/1990 and 196039/1991, hydroxypyridine-based cyan couplers and hydroxydiazine-based cyan couplers such as those disclosed in Japanese Patent O.P.I. Publication Nos. 103848/1991 and 103849/1991 and aminopyridine-based cyan couplers such as those disclosed in Japanese Patent O.P.I. Publication No. 206450/1991, all of which are excellent in color reproduction, image storage stability and recolorability.

Examples of cyan couplers for the present invention are given below.

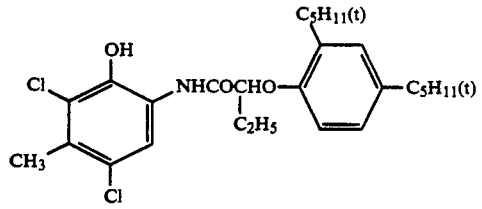
CC-1
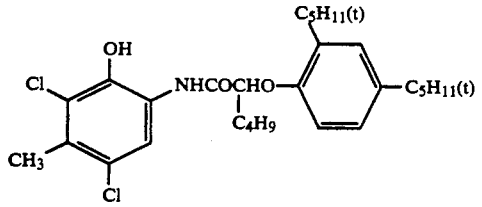
CC-2
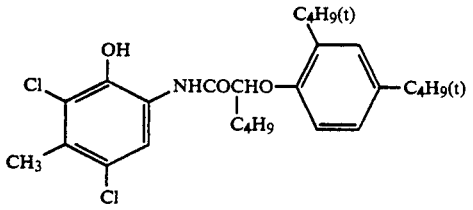
CC-3
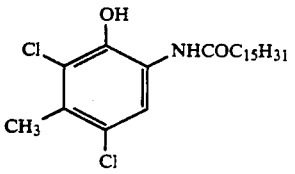
CC-4
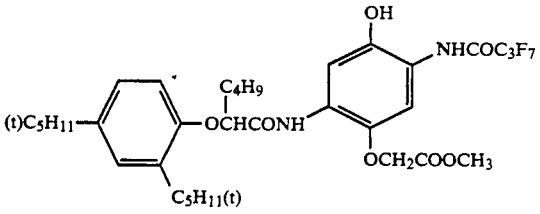
CC-5
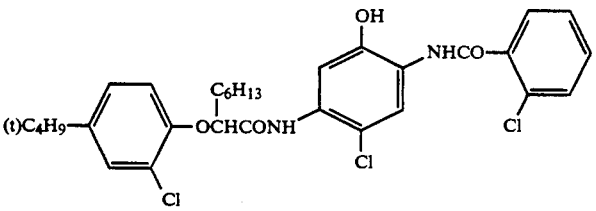
CC-6
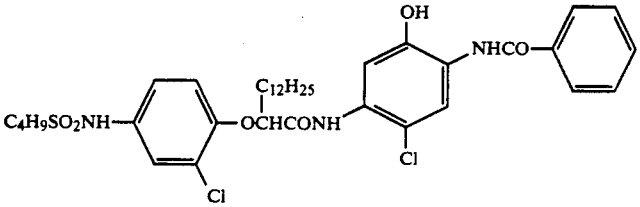
CC-7

-continued

CC-8

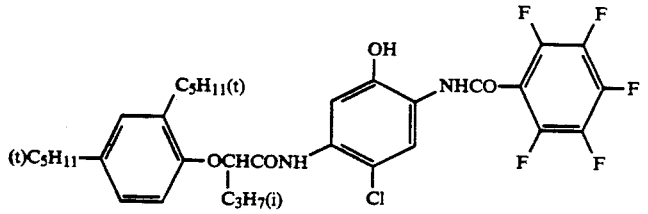

CC-9

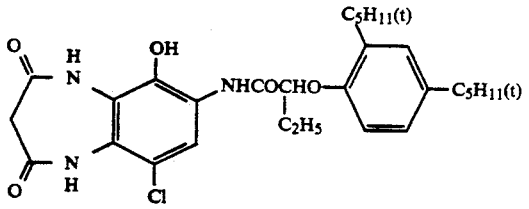

CC-10

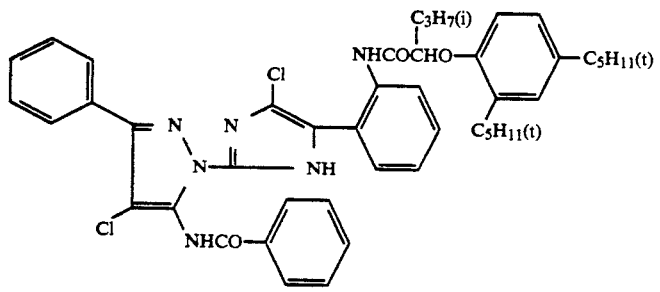

CC-11

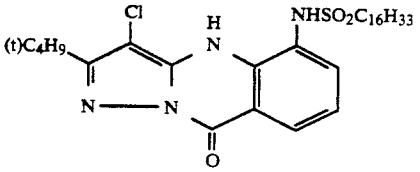

CC-12

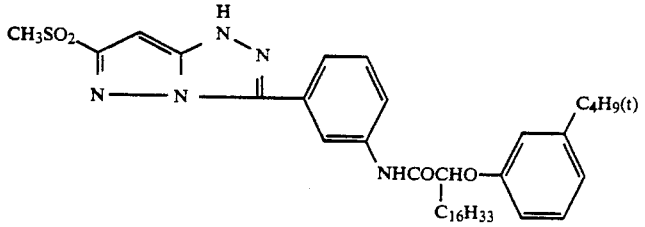

CC-13

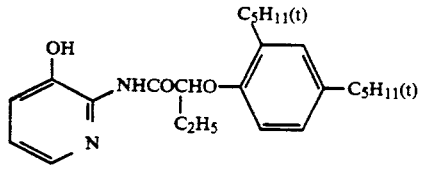

CC-14

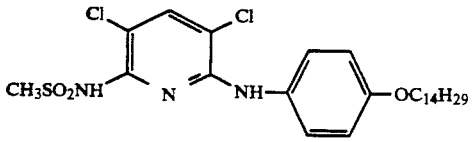

Dye forming couplers and other hydrophobic compounds for the present invention are dissolved in a high boiling organic solvent having a boiling point of over about 150° C. in the presence of a low boiling organic solvent and/or water-soluble organic solvent added as necessary. The resulting solution is emulsified in a hydrophilic binder such as an aqueous solution of gelatin using a means of dispersion such as a mechanical stirrer, a homogenizer, a colloid mill, a flow jet mixer or an ultrasonicator in the presence of a surfactant, and the resulting emulsion is added to the target hydrophilic colloid layer.

Examples of high boiling organic solvents which can be used for the present invention include esters such as phthalates and phosphates, amides of organic acid, ketones and hydrocarbon compounds, specifically Example Compound Nos. A-1 through A-120 described on pages 4 through 7 of Japanese Patent O.P.I. Publication No. 196048/1989, Example Compound Nos. II-1 through II-29 described on pages 8 and 9 of the same publication, Example Compound Nos. H-1 through H-22 described on pages 14 and 15 of the same publication, Example Compound Nos. S-1 through S-69 described on pages 3 through 7 of Japanese Patent O.P.I. Publication No. 209446/1989 and Example Compound Nos. I-1 through I-95 described on pages 10 through 12 of Japanese Patent O.P.I. Publication No. 253943/1988.

The light-sensitive material of the present invention may optionally incorporate an anti-foggant, an image stabilizer, a hardener, a plasticizer, an anti-irradiation dye, a polymer latex, an ultraviolet absorbent, a formalin scavenger, a developing accelerator, a developing retarder, a brightening agent, a matting agent, a lubricant, an antistatic agent, a surfactant and other additives. These compounds are described in Japanese Patent O.P.I. Publication Nos. 215272/1987 and 46436/1988, for instance.

The color developing agent used in the color developer for the light-sensitive material of the present invention is an aminophenol or p-phenylenediamine compound, which is widely used in various color photographic processes, with preference given to a primary amine based color developing agent.

Examples of aromatic primary amine based developing agents are as follows:

(1) N,N-dimethyl-p-phenylenediamine hydrochloride
(2) N-methyl-p-phenylenediamine hydrochloride
(3) 2-amino-5-(N-ethyl-N-dodecylamino)toluene
(4) N-ethyl-N-(β-methanesulfonamidoethyl)-3-methyl-4-aminoaniline sulfate
(5) N-ethyl-N-(β-hydroxyethyl)-3-methyl-4-aminoaniline sulfate
(6) 4-amino-3-methyl-N,N-3-diethylaniline
(7) 4-amino-N-(β-methoxyethyl)-N-ethyl-3-methylaniline p-toluenesulfonate
(8) 4-amino-N-ethyl-N-(β-hydroxypropyl)-3-methylaniline p-toluenesulfonate Preferably, these color developing agents are used in the content range from 0.001 to 0.2 mol, preferably from 0.005 to 0.2 mol per liter of developer.

In addition to the above color developing agent, known developer component compounds may be added to the color developer. It is a common practice to use a pH-buffering alkali agent, a chloride ion, a development inhibitor such as benzotriazole, a preservative, a chelating agent and other additives.

Alkali agents used in the above color developer include potassium carbonate, potassium borate and trisodium phosphate; sodium hydroxide, potassium hydroxide, etc. are used mainly to regulate pH levels. The pH of the color developer is normally 9 to 12, preferably 9.5 to 11.

For the purpose of inhibiting development, halide ions are often used, while chloride ions are commonly used for rapid development, including potassium chloride and sodium chloride. The chloride ion content is roughly not less than $3.0\times10^{-2}$ mol, preferably 4.0 to $10^{-2}$ to $5.0\times10^{-1}$ mol per liter of color developer. The amount of bromide ion, which offers a great developing inhibiting effect, is roughly not more than $1.0\times10^{-3}$ mol, preferably not more than $5.0\times10^{-4}$ mol per liter of color developer.

Effective organic preservatives include hydroxylamine derivatives other than hydroxylamine, hydroxamic acids, hydrazines, hydrazidoaminoketones, sugars, monoamines, diamines, polyamines, quaternary ammonium salts, nitroxyl radicals, alcohols, oximes, diamide compounds and condensed cyclic amines, with preference given to dialkyl-substituted hydroxylamines such as diethyl hydroxylamine and alkanolamines such as triethanolamine.

Chelating agents used in the color developer relating to the present invention include aminopolycarboxylic acid, aminopolyphosphonic acid, alkylphosphonic acid, phosphonocarboxylic acid, with preference given to ethylenediaminetetraacetic acid, nitrilotriacetic acid, diethylenetriaminepentaacetic acid and 1-hydroxyethylidene-1,1-diphosphonic acid.

Color developing temperature is normally over 15° C, specifically in the range of 20° to 50° C. For rapid processing, it is preferable to carry out the color developing process at a temperature of over 30° C.

Although color developing time is normally 10 seconds to 4 minutes, it is preferable to carry out color developing for 10 seconds to 1 minutes when rapid processing is desired, and for 10 to 30 seconds when rapider processing is desired.

When a process is run while continuously supplying the color developer, it is also preferable that the color developer replenishing rate be 20 to 60 ml per $m^2$ of light-sensitive material from the viewpoint of elimination of overflown liquid from the color developer for mitigation of the problem of environmental pollution due to waste liquid.

The light-sensitive material of the present invention is subjected to bleaching and fixation after color development. Bleaching may be carried out simultaneously with fixation. Fixation is normally followed by washing, which may be replaced by stabilization.

Although the developing apparatus used to develop the light-sensitive material of the present invention may be of the roller transport type, in which the light-sensitive material is transported while being kept between rollers equipped in the processing tank, or of the endless belt type, in which the light-sensitive material is transported while being fixed on a belt, the light-sensitive material may be transported while supplying the processing solution to a processing tank having a slit.

EXAMPLES

Example 1

Using a slide hopper, layers with the compositions shown in Tables 1 and 2 were simultaneously coated on a paper support laminated with polyethylene on one face and titanium-oxide-containing polyethylene on the opposite face, emulsion layer coating surface, to obtain a multiple-layered color light-sensitive material, Sample No. 101. The coating solutions were prepared as follows:

First layer coating solution 26.7 g of a yellow coupler YC-8, 10.0 g of a dye image stabilizer ST-1, 6.67 g of another dye image stabilizer ST-2, 0.67 g of an antistaining agent HQ-1 and 6.67 g of a high boiling organic solvent DNP were dissolved in 60 ml of ethyl acetate. This solution was emulsified and dispersed in 220 ml of a 10% aqueous solution of gelatin containing 7 ml of 20% surfactant SU-2 using an ultrasonic homogenizer, to yield a yellow coupler dispersion. This dispersion was mixed with a blue-sensitive silver halide emulsion containing 8.67 g of silver prepared under the following conditions, followed by the addition of an anti-irradiation dye AI-3, to yield a first layer coating solution.

The second through seventh layer coating solutions were prepared in the similar manner to the first layer coating solution.

Hardeners HH-1 and HH-2 were added to layers 2 and 4 and layer 7, respectively. Surfactants SU-1 and SU-3, as coating aids, were added to adjust surface tension.

TABLE 1

| Layer | Composition | Amount of addition ($g/m^2$) |
|---|---|---|
| Layer 7: | Gelatin | 1.00 |
| Layer 6: | Gelatin | 0.40 |
| Ultraviolet ray | UV ray absorber UV-1 | 0.10 |
| absorbing layer | UV ray absorber UV-2 | 0.04 |
| | UV ray absorber UV-3 | 0.16 |
| | Antistaining agent HQ-1 | 0.01 |
| | DNP | 0 20 |
| | PVP | 0.03 |
| | Anti-irradiation dye AI-2 | 0.02 |
| Layer 5: | Gelatin | 1.30 |
| Red-sensitive | Red-sensitive silver | 0.21 |
| layer | chlorobromide emulsion Em-R | |
| | Cyan coupler CC-2 | 0.24 |
| | Cyan coupler CC-8 | 0.08 |
| | Dye image stabilizer ST-1 | 0.20 |
| | Antistaining agent HQ-1 | 0.01 |
| | HBS-1 | 0.20 |
| | DOP | 0.20 |
| Layer 4: | Gelatin | 0.94 |
| Ultraviolet | UV ray absorber UV-1 | 0.28 |
| absorbing layer | UV ray absorber UV-2 | 0.09 |
| | UV ray absorber UV-3 | 0.38 |
| | Antistaining agent HQ-1 | 0.03 |
| | DNP | 0.40 |

TABLE 2

| Layer | Composition | Amount of addition ($g/m^2$) |
|---|---|---|
| Layer 3: | Gelatin A | 1.240 |
| Green- | Green-sensitive | 0.12 |
| sensitive layer | silver chlorobromide emulsion Em-G | |

TABLE 2-continued

| Layer | Composition | Amount of addition ($g/m^2$) |
|---|---|---|
| | Magenta coupler MM-1 | 0.50* |
| | Dye image stabilizer ST-3 | 0.15 |
| | Dye image stabilizer ST-4 | 0.02 |
| | Dye image stabilizer ST-5 | 0.03 |
| | HBS-2 | 0.20 |
| | Anti-irradiation dye AI-1 | 0.01 |
| Layer 2: | Gelatin | 1.20 |
| Interlayer | Antistaining agent HQ-2 | 0.10 |
| | DIDP | 0.06 |
| | Fungicide F-1 | 0.002 |
| Layer 1: | Gelatin | 1.20 |
| Blue-sensitive | Blue-sensitive silver | 0.26 |
| layer | chlorobromide emulsion Em-B | |
| | Yellow coupler YC-8 | 0.80 |
| | Dye image stabilizer ST-1 | 0.30 |
| | Dye image stabilizer ST-2 | 0.20 |
| | Antistaining agent HQ-1 | 0.02 |
| | Anti-irradiation dye AI-3 | 0.01 |
| | DNP | 0.20 |
| Support | Polyethylene-laminated paper | |

Figures for the amount of silver halide emulsion added are based on the amount of silver.

*: Expressed in $mmol/m^2$.

The additives used in these layers are as follows:

HH-1: Tetrakis(vinylsulfonylmethyl)methane
HH-2: 2,4-dichloro-6-hydroxy-s-triazine sodium
SU-1: Sodium tri-isopropylnaphthalenesulfonate
SU-2: Sodium di(2-ethylhexyl) sulfosuccinate
SU-3: Sodium di(2,2,3,3,4,4,5,5-octafluoropentyl) sulfosuccinate
DOP Dioctyl phthalate
DNP: Dinonyl phthalate
DIDP: Di-isodecyl phthalate
PVP: Polyvinyl pyrrolidone
HBS-1:1-dodecyl-4-(p-toluenesulfonamido)benzene
HBS-2:2:1 (by volume) mixture of tri(2-ethylhexyl) phosphate and tricresyl phosphate
HQ-1: 2,5-di-t-octylhydroquinone
HQ-2: 2-hexadecyl-5-methylhydroquinone
F-1:5-chloro-2-methylisothiazolin-3-one

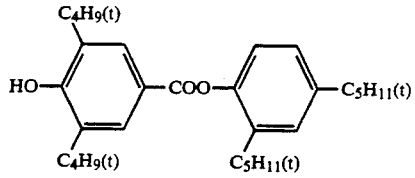

ST-1

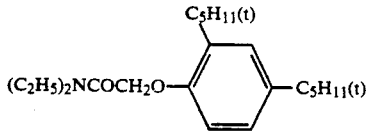

ST-2

-continued
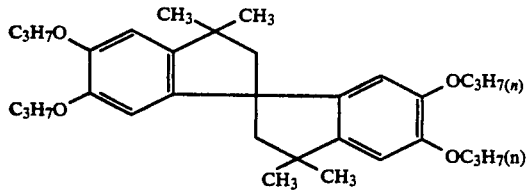
ST-3
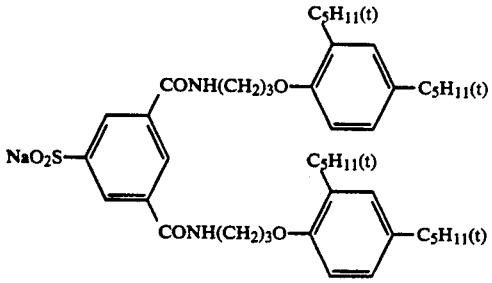
ST-4
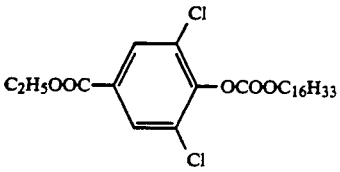
ST-5
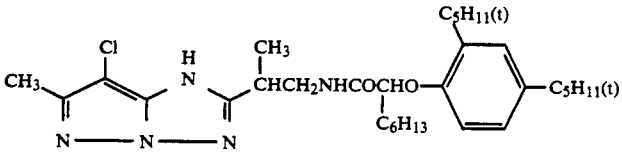
MM-1
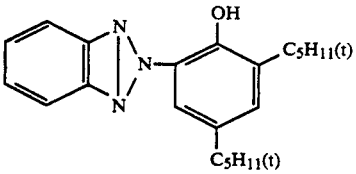
UV-1
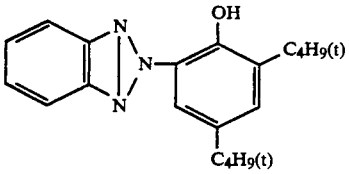
UV-2
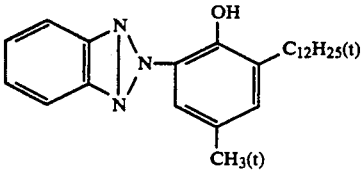
UV-3
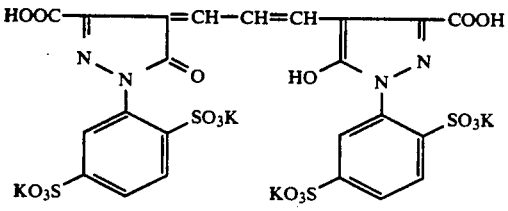
AI-1

-continued

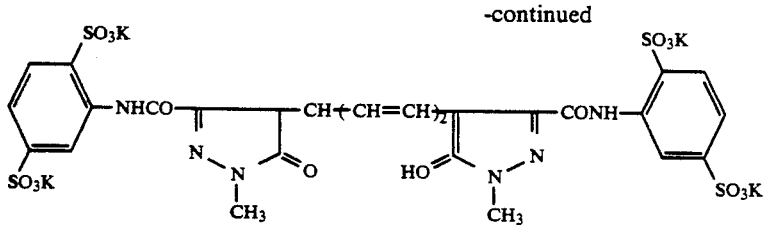

AI-2

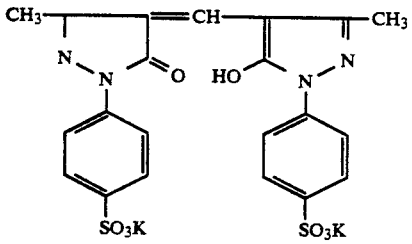

AI-3

Preparation of blue-sensitive silver halide emulsion Em-B

To 1000 ml of a 2% aqueous solution of gelatin incubated at 40° C., the following solutions A and B were simultaneously added over a period of 30 minutes while maintaining a pAg of 6.5 and a pH of 3.0, after which the following solutions C and D were simultaneously added over a period of 180 minutes while maintaining a pAg of 7.3 and a pH of 5.5. The pAg was regulated by the method described in Japanese Patent O.P.I. Publication No. 45437/1984, and the pH was regulated using an aqueous solution of sulfuric acid or sodium hydroxide.

Solution A

| | |
|---|---|
| Sodium chloride | 3.42 g |
| Potassium bromide | 0.03 g |

Water was added to make a total quantity of 200 ml.

Solution B

| | |
|---|---|
| Silver nitrate | 10 g |

Water was added to make a total quantity of 200 ml.

Solution C

| | |
|---|---|
| Sodium chloride | 102.7 g |
| Potassium bromide | 1.0 g |

Water was added to make a total quantity of 600 ml.

Solution D

| | |
|---|---|
| Silver nitrate | 300 g |

Water was added to make a total quantity of 600 ml.

After completion of the addition, the mixture was desalted with a 5% aqueous solution of Demol N, a product of Kao Atlas, and a 20% aqueous solution of magnesium sulfate, and was then mixed with an aqueous solution of gelatin to obtain a monodispersed emulsion EMP-1 comprising cubic grains having an average grain size of 0.85 μm, a coefficient of variance of 0.07 and a silver chloride content of 99.5 mol %.

The emulsion EMP-1 was chemically ripened with the following compounds at 50° C. for 90 minutes to yield a blue-sensitive silver halide emulsion Em-B.

| | |
|---|---|
| Sodium thiosulfate | 0.8 mg/mol AgX |
| Chloroauric acid | 0.5 mg/mol AgX |
| Stabilizer STAB-1 | $6 \times 10^{-4}$ mol/mol AgX |
| Sensitizing dye D-1 | $4 \times 10^{-4}$ mol/mol AgX |
| Sensitizing dye D-4 | $1 \times 10^{-4}$ mol/mol AgX |

Preparation of green-sensitive silver halide emulsion Em-G

A monodispersed emulsion EMP-2 comprising cubic grains having an average grain size of 0.43 μm, a coefficient of variance of 0.08 and a silver chloride content of 99.5 mol% was prepared in the same manner as EMP-1 except that the addition time for Solutions A and B and the addition time for Solutions C and D were changed.

The emulsion EMP-2 was chemically ripened with the following compounds at 55° C for 120 minutes to yield a green-sensitive silver halide emulsion Em-G.

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Sensitizing dye D-2 | $4 \times 10^{-4}$ mol/mol AgX |

Preparation of red-sensitive silver halide emulsion Em-R

A monodispersed emulsion EMP-3 comprising cubic grains having an average grain size of 0.50 μm, a coefficient of variance of 0.08 and a silver chloride content of 99.5 mol % was prepared in the same manner as with EMP-1 except that the addition time for Solutions A and B and the addition time for Solutions C and D were changed.

The emulsion EMP-3 was chemically ripened with the following compounds at 60° C. for 90 minutes to yield a red-sensitive silver halide emulsion Em-R.

| | |
|---|---|
| Sodium thiosulfate | 1.8 mg/mol AgX |
| Chloroauric acid | 2.0 mg/mol AgX |
| Stabilizer STAB-1 | $6 \times 10^{-4}$ mol/mol AgX |

-continued

| Sensitizing dye D-3 | $1 \times 10^{-4}$ mol/mol AgX |
|---|---|

STAB-1: 1-(3-acetamidophenyl)-5-mercaptotetrazole

D-1

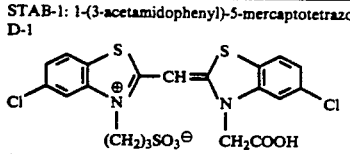

D-2

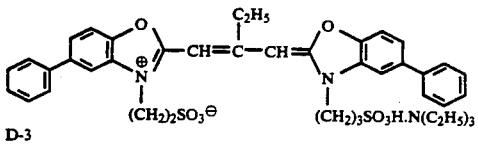

D-3

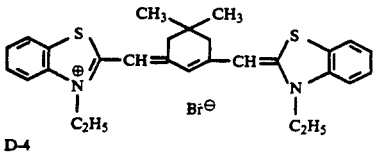

D-4

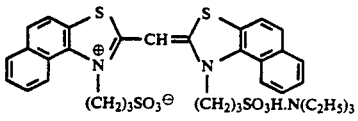

Next, sample Nos. 102 through 129 were prepared in the same manner as sample No. 101, except that gelatin A contained in sample No. 101 was replaced with an equal amount of a gelatin listed in Table 3 and that magenta coupler MM-1 contained in layer 3 was replaced with an equal molar amount of magenta coupler listed in Table 3.

The samples thus obtained were evaluated as follows:

Light fastness of image

The sample was subjected to green light exposure through an optical wedge in accordance with a conventional method, and then processed using the following processes, after which it was stored under direct sunlight for 2 months, and the percent dye image residual rate at an initial density of 1.0 was determined.

Coating solution stability

After preparation, the coating solution for the green-sensitive emulsion layer was kept warmed at 40° C. for 2 hours or 10 hours before coating. Sensitivity change ΔS between the two samples was determined. Sensitivity was determined by sensitometry of the sample subjected to green light exposure through an optical wedge and then processed in accordance with the following processes.

$$\Delta S = (S_{10}/S_2) \times 100$$

where $S_{10}$ is the sensitivity of the sample coated 10 hours after coating solution preparation, and $S_2$ is the sensitivity of the sample coated 2 hours after coating solution preparation.

| Procedure | Temperature (°C.) | Treatment time |
|---|---|---|
| Color development | 35.0 ± 0.3° C. | 45 seconds |
| Bleach-fixation | 35.0 ± 0.5° C. | 45 seconds |
| Stabilization | 30 to 34° C. | 90 seconds |
| Drying | 60 to 80° C. | 60 seconds |

The compositions of the processing solutions are as follows:

| Color developer | Tank solution |
|---|---|
| Water | 800 ml |
| Triethanolamine | 10 g |
| N,N-diethylhydroxylamine | 5 g |
| Potassium chloride | 2.4 g |
| 1-hydroxyethylidene-1,1-diphosphonic acid | 1.0 g |
| Ethylenediaminetetraacetic acid | 1.0 g |
| N-ethyl-N-β-methanesulfonamidoethyl-3-methyl-4-aminoaniline sulfate | 5.4 g |
| Brightening agent 4,4'-diaminostylbenedisulfonic acid derivative | 1.0 g |
| Potassium carbonate | 27 g |

Water was added to make a total quantity of 1 l, and the pH was adjusted to 10.02.

| Bleach-fixer | |
|---|---|
| Ammonium ferric ethylenediaminetetraacetate dihydrate | 60 g |
| Ethylenediaminetetraacetic acid | 3 g |
| Ammonium thiosulfate (70% aqeuous solution) | 100 ml |
| Ammonium sulfite (40% aqueous solution) | 27.5 ml |

Water was added to make a total quantity of 1 l, and potassium carbonate or glacial acetic acid was added to obtain a pH of 5.7.

| Stabilizer | |
|---|---|
| F-1 | 1.0 g |
| Ethylene glycol | 1.0 g |
| 1-hydroxyethylidene-1,1-diphosphonic acid | 2.0 g |
| Ethylenediaminetetraacetic acid | 1.0 g |
| Ammonium hydroxide (20% aqueous solution) | 3.0 g |
| Brightening agent 4,4'-diaminostylbenedisulfonic acid derivative | 1.5 g |

Water was added to make a total quantity of 1 l, and sulfuric acid or potassium hydroxide was added to obtain a pH of 7.0.

The results are given in Table 3.

TABLE 3

| Sample No. | Gelatin | Magenta coupler | Light fastness (%) | Coating solution stability ΔS (%) |
|---|---|---|---|---|
| 101 (comparative) | A | MM-1 | 71 | 81 |
| 102 (inventive) | B | MM-1 | 72 | 95 |
| 103 (inventive) | C | MM-1 | 69 | 97 |
| 104 (inventive) | D | MM-1 | 72 | 97 |
| 105 (comparative) | A | M-3 | 82 | 74 |
| 106 (inventive) | B | M-3 | 83 | 91 |
| 107 (inventive) | C | M-3 | 84 | 93 |
| 108 (inventive) | D | M-3 | 82 | 94 |
| 109 (comparative) | A | M-9 | 85 | 77 |
| 110 (inventive) | B | M-9 | 84 | 90 |
| 111 (inventive) | C | M-9 | 87 | 93 |
| 112 (inventive) | D | M-9 | 86 | 95 |
| 113 (comparative) | A | M-17 | 84 | 70 |
| 114 (comparative) | B | M-17 | 86 | 89 |
| 115 (inventive) | C | M-17 | 83 | 91 |
| 116 (inventive) | D | M-17 | 85 | 90 |
| 117 (comparative) | A | M-24 | 82 | 75 |
| 118 (inventive) | B | M-24 | 84 | 92 |
| 119 (inventive) | C | M-24 | 83 | 95 |
| 120 (inventive) | D | M-24 | 81 | 95 |
| 121 (inventive) | D | M-1 | 76 | 91 |
| 122 (inventive) | D | M-4 | 81 | 92 |
| 123 (inventive) | D | M-8 | 87 | 95 |
| 124 (inventive) | D | M-10 | 85 | 94 |
| 125 (inventive) | D | M-12 | 83 | 94 |
| 126 (inventive) | D | M-15 | 86 | 91 |
| 127 (inventive) | D | M-20 | 84 | 94 |
| 128 (inventive) | D | M-26 | 81 | 90 |

TABLE 3-continued

| Sample No. | Gelatin | Magenta coupler | Light fastness (%) | Coating solution stability ΔS (%) |
|---|---|---|---|---|
| 129 (inventive) | D | M-27 | 83 | 92 |

Gelatin A: Alkali-processed gelatin from cattele-bone without hydrogen peroxide treatment Gelatin B: Prepared by treating gelatin A with hydrogen peroxide in an amount of 0.2 g hydrogen peroxide/kg gelatin Gelatin C: Prepared by treating gelatin A with hydrogen peroxide in an amount of 1.0 g hydrogen peroxide/kg gelatin Gelatin D: Prepared by treating gelatin A with hydrogen peroxide in an amount of 4.0 g hydrogen peroxide/kg gelatin Gelatin without notation in the above-mentioned means an alkali-processed cattle-bone gelatin without hydrogen peroxide treatment.

From Table 3, it is seen that the samples incorporating non-inventive gelatin A had poor coating solution stability and a high value of sensitivity change (ΔS). In contrast, the samples incorporating inventive gelatin B, C or D had good coating solution stability and improved lot-to-lot stability of sensitivity.

In addition, sample Nos. 105 through 129, all of which incorporated the magenta coupler of the present invention, had improved light fastness, in comparison with sample Nos. 101 through 104, all of which incorporated a non-inventive magenta coupler. It was also found that the samples incorporating both types are light-sensitive materials excellent in production stability and image storage stability.

Example 2

In the same manner as in Example 1, coating solution samples were prepared by preparing dispersions of yellow, magenta and cyan couplers in gelatins A, B and C of Example 1, respectively, and using the combinations of a coating solution gelatin and magenta coupler shown in Table 4. The amount of gelatin used to disperse the magenta coupler was 18% by weight of the total gelatin content in the green-sensitive layer.

In this case as well, light fastness and coating solution retention were determined in the same manner as in Example 1. The results are given in Table 4.

TABLE 4

| Sample No. | Gelatin added to emulsion | Gelatin used in coupler dispersion | Magenta coupler | Light fastness (%) | Coating solution stability ΔS (%) |
|---|---|---|---|---|---|
| 130 (comparative) | A | A | MM-1 | 72 | 80 |
| 131 (comparative) | A | B | MM-1 | 71 | 82 |
| 132 (comparative) | A | C | MM-1 | 70 | 83 |
| 133 (invention) | B | A | MM-1 | 71 | 90 |
| 134 (invention) | B | B | MM-1 | 69 | 94 |
| 135 (invention) | B | C | MM-1 | 71 | 97 |
| 136 (invention) | C | A | MM-1 | 70 | 95 |
| 137 (invention) | C | B | MM-1 | 72 | 98 |
| 138 (comparative) | C | C | MM-1 | 70 | 98 |
| 139 (comparative) | A | A | M-3 | 83 | 74 |
| 140 (comparative) | A | B | M-3 | 84 | 77 |
| 141 (comparative) | A | C | M-3 | 82 | 78 |
| 142 (invention) | B | A | M-3 | 80 | 92 |
| 143 (invention) | B | B | M-3 | 82 | 95 |
| 144 (invention) | B | C | M-3 | 82 | 96 |
| 145 (invention) | C | A | M-3 | 83 | 93 |
| 146 (invention) | C | B | M-3 | 84 | 96 |
| 147 (invention) | C | C | M-3 | 82 | 98 |
| 148 (comparative) | A | A | M-17 | 86 | 71 |
| 149 (comparative) | A | C | M-17 | 85 | 75 |
| 150 (invention) | C | A | M-17 | 87 | 92 |
| 151 (invention) | C | C | M-17 | 86 | 98 |
| 152 (comparative) | A | A | M-24 | 83 | 74 |
| 153 (comparative) | A | C | M-24 | 82 | 77 |
| 154 (invention) | C | A | M-24 | 84 | 95 |
| 155 (invention) | C | C | M-24 | 85 | 99 |

From Table 4, it is seen that the samples incorporating the gelatin of the present invention not only as a gelatin added to emulsion after chemical ripening but also as a gelatin for coupler dispersion have markedly improved coating solution retention.

Also, the use of the gelatin of the present invention in combination with the magenta coupler of the present invention offers a light-sensitive material excellent in image storage stability and production stability as in Example 1.

Another finding was that the gelatin of the present invention does not offer a sufficient coating solution stability improving effect when used at contents of not more than 20% by weight.

Example 3

The samples prepared in Example 2 were subjected to blue, green and red light exposure through an optical wedge, and the coating solution stability of the blue-, green- and red-sensitive emulsions were determined.

Table 5 shows the samples tested and the results of evaluation.

TABLE 5

| Sample No. | Gelatin added to blue-sensitive emulsion | Gelatin used in yellow coupler dispersion | Gelatin added to green-sensitive emulsion | Gelatin used in magenta coupler dispersion | Magenta coupler | Gelatin added to red-sensitive emulsion | Gelatin used in cyan coupler dispersion | Coating solution stability | | |
|---|---|---|---|---|---|---|---|---|---|---|
| | | | | | | | | $S_B$ | $S_G$ | $S_R$ |
| 130 (Comparative) | A | A | A | A | MM-1 | A | A | 73 | 81 | 85 |
| 138 (Inventive) | C | C | C | C | MM-1 | C | C | 94 | 96 | 96 |
| 139 (Comparative) | A | A | A | A | M-3 | A | A | 72 | 75 | 84 |
| 147 (Inventive) | C | C | C | C | M-3 | C | C | 96 | 95 | 97 |
| 155 (Inventive) | C | C | C | C | M-24 | C | C | 96 | 96 | 97 |

$\Delta S_B$: Percent sensitivity obtained by blue light exposure
$\Delta S_G$: Percent sensitivity obtained by green light exposure
$\Delta S_R$: Percent sensitivity obtained by red light exposure From Table 5, it is seen that the use of the gelatin of the present invention offers a light-sensitive material with significantly improved coating solution stability not only in the green-sensitive emulsion but also in the blue- and red-sensitive emulsions and a well-balanced sensitivity distribution among the three layers.

Particularly, sample Nos. 147 and 155, which incorporate the gelatin of the present invention and the coupler of the present invention in combination, are light-sensitive materials generally excellent in image storage stability and production stability.

What is claimed is:

1. A silver halide photographic light-sensitive material comprising a support having thereon a silver halide emulsion layer, wherein said silver halide emulsion layer comprises a hydrogen peroxide-treated gelatin in an amount not less than 20% by weight of the total weight of gelatin contained in said silver halide emulsion layer; silver halide grains composed of silver chlorobromide having a silver chloride content not less than 90 mol %; and a magenta coupler of the formula M-I

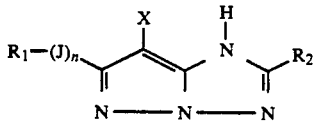

(M-I)

wherein J is —O—, —S— or N($R_3$)— in which $R_3$ is hydrogen atom or a substituent; n is 0 or 1, when n is 0,$R_1$ is an alkyl group having 2 or more carbon atoms or an aryl group and when n is 1, $R_1$ is an alkyl group or an aryl group; $R_2$ is hydrogen or a substituent; and X is a hydrogen atom or a substituent capable of splitting off upon reaction with the oxidation product of a color developing solution.

2. The light sensitive material of claim 1, wherein said magenta coupler has the formula (M-II) or (M-III):

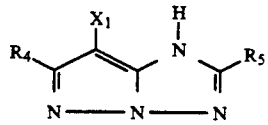

(M-II)

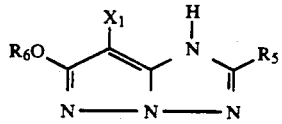

(M-III)

wherein $R_4$ is an i-propyl group or a t-butyl group; $R_5$ is a substituent and $R_6$ is an alkl group or an aryl group and $X_1$ is a hydrogen atom or a substituent capable of splitting off upon reaction with the oxidation product of a color developing solution.

3. The light-sensitive material of claim 1, wherein said hydrogen peroxide-treated gelatin is a gelatin treated with hydrogen peroxide in an amount of 0.1 g to 3.0 g per 1 kg of gelatin.

4. The light-sensitive material of claim 3, wherein said hydrogen peroxide-treated gelatin is a gelatin treated with hydrogen peroxide in an amount of 0.3 g to 1.0 g per 1 kg of gelatin.

5. The light-sensitive material of claim 1, wherein the amount of said hydrogen peroxide-treated gelatin is not lower than 50% by weight of the total amount of gelatin contained in said silver halide emulsion layer.

6. The light-sensitive material of claim 5, wherein the amount of said hydrogen peroxide-treated gelatin is not lower than 80% by weight of the total amount of gelatin contained in said silver halide emulsion layer.

* * * * *